US006760212B2

(12) United States Patent
Cheever, Jr. et al.

(10) Patent No.: US 6,760,212 B2
(45) Date of Patent: Jul. 6, 2004

(54) PIEZOELECTRIC INJECTOR DRIVE CIRCUIT

(75) Inventors: Gordon D. Cheever, Jr., Peru, IN (US); Nigel P Baker, Kent (GB); Steven J. Martin, Kent (GB); Joseph A. Engel, Oberkorn (LU); Joel F. Downey, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/403,713

(22) Filed: Mar. 31, 2003

(65) Prior Publication Data

US 2004/0057189 A1 Mar. 25, 2004

Related U.S. Application Data

(63) Continuation-in-part of application No. 10/252,237, filed on Sep. 23, 2002.

(51) Int. Cl.[7] ..... H01H 47/00
(52) U.S. Cl. ..... 361/160; 361/152
(58) Field of Search ..... 361/152, 144, 361/160, 115

(56) References Cited

U.S. PATENT DOCUMENTS

| | | | | |
|---|---|---|---|---|
| 4,101,076 A | | 7/1978 | Bart | 239/584 |
| 4,635,849 A | | 1/1987 | Igashira et al. | 239/102 |
| 5,697,342 A | * | 12/1997 | Anderson et al. | 123/446 |
| 5,713,326 A | * | 2/1998 | Huber | 123/299 |
| 6,234,404 B1 | * | 5/2001 | Cooke | 239/88 |
| 6,253,736 B1 | * | 7/2001 | Crofts et al. | 123/498 |
| 6,345,606 B1 | | 2/2002 | Ricci-Ottati et al. | 123/456 |
| 6,411,009 B2 | * | 6/2002 | Jaenker | 310/316.01 |
| 6,420,817 B1 | | 7/2002 | Ricci-Ottati et al. | 310/316.01 |
| 6,520,423 B1 | | 2/2003 | Ricci-Ottati et al. | 239/89 |

* cited by examiner

*Primary Examiner*—Stephen W. Jackson
(74) *Attorney, Agent, or Firm*—Jimmy L. Funke; Stefan V. Chmielewski

(57) ABSTRACT

A drive circuit is provided in a full H-bridge and half H-bridge configuration for controlling one or more piezoelectric fuel injectors. The drive circuit includes a voltage input for receiving a voltage signal, an energy storage device coupled to the voltage input for storing an electrical charge, a bidirectional current path coupled to one or more piezoelectric injectors, an inductor coupled in series with the piezoelectric injector(s) in the bidirectional current path, and switching circuitry for controlling current flow through the piezoelectric injector(s) and the inductor to open and close the piezoelectric injector(s). The switching circuitry is controlled to provide a recirculation current to recover energy stored in the piezoelectric injector(s) for storage in the energy storage device.

41 Claims, 11 Drawing Sheets

234.0
232.0
230.0
228.0
$V_{C1}$ (volts)
0.0
100
200
300
400
500
600
700
800
TIME (us)
40
42
44
46
48

40.0
20.0
0.0
-20.0
-40.0
$I_{L1}$ (Amps)
0.0
100
200
300
400
500
600
700
800
TIME (us)
50
52
54
56
58

400.0
200.0
0.0
-200.0
$V_{INJ}$ (volts)
0.0
100
200
300
400
500
600
700
800
TIME (us)
60
62
64

PIEZOELECTRIC INJECTOR DRIVE CIRCUIT

CROSS-REFERENCE TO RELATED APPLICATION

This application is a continuation-in-part of application Ser. No. 10/252,237 entitled "PIEZOELECTRIC INJECTOR DRIVE CIRCUIT," filed on Sep. 23, 2002.

TECHNICAL FIELD

The present invention generally relates to fuel injector drive circuitry and, more particularly, relates to a drive circuit for a piezoelectric fuel injector.

BACKGROUND OF THE INVENTION

Automotive vehicle engines are generally equipped with fuel injectors for injecting fuel (e.g., gasoline or diesel fuel) into the individual cylinders or intake manifold of the engine. The engine fuel injectors are coupled to a fuel rail which contains high pressure fuel that is delivered by way of a fuel delivery system. Conventional fuel injectors typically employ a valve that is actuated to open and close to control the amount of fluid fuel metered from the fuel rail and injected into the corresponding engine cylinder or intake manifold.

One type of fuel injector that offers precise metering of fuel is the piezoelectric fuel injector. Piezoelectric fuel injectors employ piezoelectric actuators for opening and closing an injection valve to meter fuel injected into the engine. Examples of piezoelectric fuel injectors are disclosed in U.S. Pat. Nos. 4,101,076 and 4,635,849, the entire disclosures of which are hereby incorporated herein by reference. Piezoelectric fuel injectors are well-known for use in automotive engines.

The metering of fuel with a piezoelectric fuel injector is generally achieved by controlling the electrical voltage potential applied to the piezoelectric elements to thereby vary the amount of expansion and contraction of the piezoelectric elements. The amount of expansion and contraction of the piezoelectric elements varies the travel distance of a valve needle and, thus, the amount of fuel that is passed through the fuel injector.

Piezoelectric fuel injectors offer the ability to precisely meter a small amount of fuel. However, piezoelectric fuel injectors also require relatively high voltages and high currents in order to function properly. Known conventional drive circuitry for controlling a piezoelectric fuel injector is generally complicated and usually requires extensive energy. Additionally, many prior piezoelectric injector drive circuits generally do not optimize injector performance over a wide operating range of the engine.

Accordingly, it is therefore desirable to provide for a less complicated and more energy efficient drive circuit for driving a piezoelectric injector, such as a fuel injector for injecting fuel into an engine. It is also desirable to provide a drive circuit that offers enhanced operation of the piezoelectric injector over a wide range of engine operating points (e.g., engine speed, load, etc.).

SUMMARY OF THE INVENTION

In accordance with the teachings of the present invention, a drive circuit is provided for controlling a piezoelectric injector. According to one aspect of the present invention, the drive circuit includes a voltage input for receiving a voltage signal and a bidirectional current path coupled to a piezoelectric injector. The drive circuit also includes an inductor coupled in series with the bidirectional current path and switching circuitry for controlling current flow through the piezoelectric injector and the inductor. The switching circuitry is controlled to operate the piezoelectric injector by causing current to flow in a first direction in the bidirectional current path to discharge the injector and by causing current to flow in a second direction in the bidirectional current path to charge the piezoelectric injector.

According to another aspect of the present invention, the drive circuit includes a voltage input for receiving a voltage signal, an energy storage device coupled to the voltage input for storing an electrical charge, a bidirectional current path coupled to a piezoelectric injector, an inductor coupled in series with the bidirectional current path, and switching circuitry for controlling current flow through the piezoelectric injector and the inductor. The switching circuitry is controlled to open and close the piezoelectric injector and is controlled to provide a recirculation current to recover energy stored in the piezoelectric injector for storage in the energy storage device. By recovering energy stored in the piezoelectric injector, an enhanced energy efficient piezoelectric injector drive circuit is provided. The drive circuit is particularly well-suited for driving a piezoelectric fuel injector for injecting fuel in an engine.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
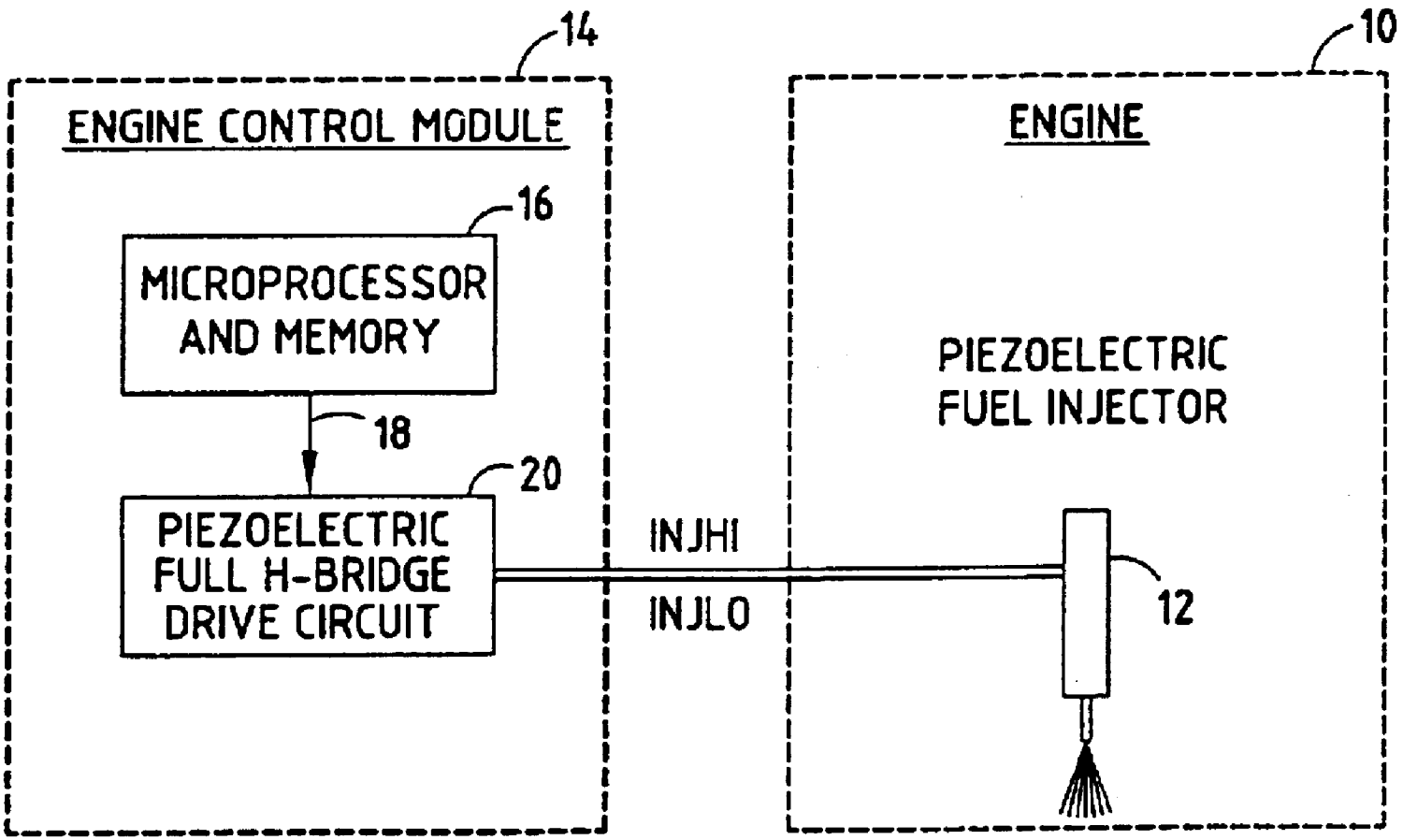
FIG. 1 is a block diagram illustrating a first embodiment of a drive circuit for controlling a piezoelectric fuel injector in an engine according to the present invention.

Referring to FIG. 1, an engine 10, such as an automotive vehicle engine, is generally shown having a piezoelectric fuel injector 12 for metering and injecting fuel into an individual cylinder or intake manifold of the engine 10. The piezoelectric fuel injector 12 controls the amount of fluid (e.g., liquid) fuel injected from a fuel rail, or other fuel delivery device, of a fuel delivery system into the engine 10. The piezoelectric fuel injector 12 may be employed in a diesel engine to inject diesel fuel into the engine or may be employed in a spark ignited internal combustion engine to inject combustible gasoline into the engine. While one piezoelectric fuel injector 12 is shown and described in the embodiment of FIG. 1, it should be appreciated that the engine 10 may include two or more piezoelectric fuel injectors, all of which could be controlled by a common drive circuit.

The engine 10 is generally controlled by an engine control module (ECM) 14. The ECM 14 generally includes a microprocessor and memory 16 for performing various control routines for controlling the operation of the engine 10, including control of the fuel injection. The ECM 14 may monitor engine speed and load and control the amount of fuel and injection timing for injecting fuel into the engine cylinder. According to the first embodiment, a piezoelectric full H-bridge drive circuit 20 is shown integrated into the engine control module 14 monitoring and controlling the injector high side voltage INJHI and injector low side voltage INJLO to control actuation of the piezoelectric fuel injector 12 to open and close the injector 12. The piezoelectric drive circuit 20 may be integrated in the engine control module 14 as shown or may be provided separate therefrom. The microprocessor and memory 16 provide various control signals 18 to the drive circuit 20.

The piezoelectric drive circuit 20 controls the opening and closing of the piezoelectric fuel injector 12 to meter and inject precise amounts of fuel into an individual cylinder or intake manifold of the engine 10. Piezoelectric drive circuit 20 as shown and described herein operates in a discharge mode which discharges the injector 12 to open the injector valve to inject fuel, and further operates in a charge mode which charges the injector 12 to close the injector valve to prevent injection of fuel. However, the drive circuit 20 and injector 12 could be otherwise configured to open during a charge mode and close during a discharge mode. It should be appreciated that the drive circuit 20 of the present invention advantageously provides simplified injector control circuitry which offers enhanced energy efficiency.

Figure 2:
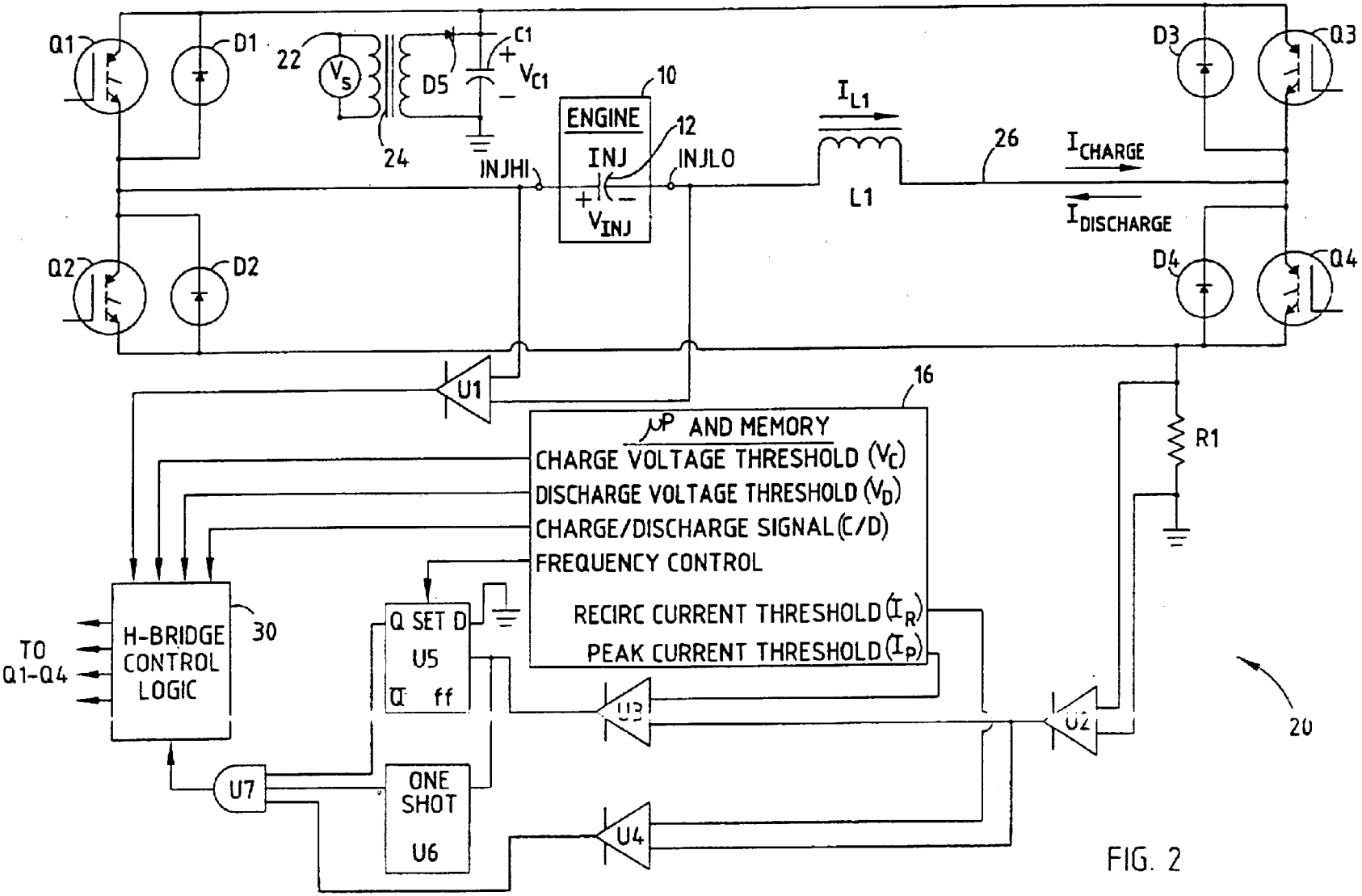
FIG. 2 is a block/circuit diagram illustrating the piezoelectric drive circuit according to the first embodiment of the present invention.

The first embodiment of the piezoelectric drive circuit 20 is further illustrated in detail in the block/circuit diagram of FIG. 2. The drive circuit 20 in the first embodiment generally is configured as a full H-bridge having a middle circuit branch 26 that serves as a bidirectional current path coupled to positive (+) and negative (−) terminals of the piezoelectric fuel injector 12. The drive circuit 20 includes a voltage input 22 for receiving a voltage $V_S$ (e.g., 12 volts) from a voltage source (e.g., vehicle battery). The voltage $V_S$ is increased to a higher step-up voltage $V_{C1}$ (e.g., 230 volts) via a step-up transformer (DC-to-DC converter) 24 or other voltage step-up device. The step-up voltage $V_{C1}$ is applied to an energy storage capacitor C1 via diode D5. The step-up voltage $V_{C1}$ applied to capacitor C1 may provide a high voltage such as 230 volts, according to one example.

The drive circuit 20 includes four switches Q1–Q4 positioned at opposite corners of the H-bridge circuit configuration. According to one embodiment, switches Q1–Q4 may each include an n-channel insulated gate bipolar transistor (IGBT) having a gate controlling current flow from the collector to the emitter. Each of switches Q1–Q4 allows for unidirectional current flow from the collector to the emitter when turned on, and prevents current flow when turned off. Connected in parallel to switches Q1–Q4 are four recirculation diodes D1–D4, respectively, for providing unidirectional current flow opposite to the direction of current flow in the corresponding switches Q1–Q4. Recirculation diodes D1–D4 allow recirculation current to return to capacitor C1 during an energy recovery mode.

The piezoelectric fuel injector 12 is shown connected in the bidirectional current path 26 across positive (+) and negative (−) terminals. The piezoelectric fuel injector 12 has the electrical characteristics of a capacitor and, thus, is shown represented as a capacitor labeled INJ. The injector 12 is chargeable to hold a voltage $V_{INJ}$ which is the voltage potential between voltages INJHI and INJLO across the positive (+) and negative (−) terminals. It should be appreciated that the piezoelectric fuel injector 12 is charged and discharged by controlling the current flow $I_{CHARGE}$ and $I_{DISCHARGE}$ through the bidirectional current path 26 as explained herein.

The drive circuit 20 includes an inductor L1 connected in series with the piezoelectric fuel injector 12 as part of the bidirectional current path 26. Inductor L1 operates as a current-limiting inductor that limits the rate of change of current flowing through the bidirectional current path 26. The drive circuit 20 advantageously employs the current-limiting inductor L1 in series with the piezoelectric fuel injector 12 in a bridge arrangement to charge and discharge the injector 12. The H-bridge drive circuit structure results in energy recovery due to the use of the current-limiting inductor L1 in conjunction with the recirculation diodes D1–D4. Additionally, the current-limiting inductor L1 limits the maximum rate of change of current flowing through the piezoelectric fuel injector 12 which prevents damage to the stack of piezoelectric elements inside of the injector 12.

The drive circuit 20 also includes a sense resistor R1 coupled between ground and the emitter of each of transistors Q2 and Q4. A differential amplifier U2 senses the voltage potential drop across sense resistor R1 so as to monitor the current flowing to or from ground through sense resistor R1. Differential amplifier U2 generates a voltage proportional to the amount of current flowing between capacitor C1 and ground, and thus the current flow through the current path 26. The output of differential amplifier U2 is applied as an input to both of comparators U3 and U4. Comparator U3 compares the sensed current to a peak current threshold $I_P$, while comparator U4 compares the sensed current to a recirculation current threshold $I_R$. In the embodiment shown, the peak current threshold $I_P$ and recirculation current threshold $I_R$ are stored and processed via the microprocessor and memory 16. Alternately, this function may be provided in discrete circuitry or a combination of discrete and microprocessor based circuitry. The peak current threshold $I_P$ and recirculation current threshold $I_R$ define a range limiting the current flow through the current path 26. Whenever the absolute value of the sensed current exceeds the peak current threshold $I_P$, the current supplied from capacitor C1 is interrupted by turning switches Q1–Q4 off. The inductor L1 causes current to continue to flow in the same direction in the current path 26 by drawing current from ground and applying the current to capacitor C1 through select pairs of recirculation diodes D1–D4 so as to transfer energy stored in the inductor L1 and the injector 12 into capacitor C1.

The drive circuit 20 monitors and controls the current flow $I_{CHARGE}$ and $I_{DISCHARGE}$ as follows. Comparator U4 determines when the absolute value of the sensed current drops below the recirculation current threshold $I_R$ and generates an output signal provided as an input to AND logic gate U7. Comparator U3 determines when the absolute value of the sensed current exceeds the peak current threshold $I_P$ and generates an output signal which, in turn, is input to both a one shot circuit U6 and a flip-flop U5. The one shot circuit U6 generates an output signal as an input to AND logic gate U7 when the absolute value of the sensed current exceeds the peak current threshold $I_P$. Flip-flop U5 generates an output signal, depending upon a frequency control input, that is provided as an input to AND logic gate U7. Accordingly, AND logic gate U7 provides a high logic output whenever the absolute value of the sensed current is within the limited current range between the peak current threshold $I_P$ and the recirculation current threshold $I_R$ and the circuit 20 is not in the recirculation phase.

The opening and closing characteristics of the piezoelectric fuel injector 12 are generally influenced by the voltage slew rate applied to the injector 12 during the discharge and charge cycles, respectively. In order to vary the voltage slew rate, the drive circuit 20 of the present invention varies the average current $I_{CHARGE}$ or $I_{DISCHARGE}$ flowing through the injector 12. As a consequence, a lower average current flowing through the injector 12 results in a reduced voltage slew rate. The average current flowing through injector 12 is controlled by changing the peak current threshold $I_P$ and/or the recirculation current threshold $I_R$.

The frequency control signal provides an optional means to vary the charge and discharge voltage slew rate by varying the frequency of the frequency control signal. It should be appreciated that the flip-flop U5 generates an output on line Q at a predetermined point of each cycle of the frequency control signal. According to one embodiment, an active edge of the frequency control signal may be used to control timing for starting each cycle of the charge and discharge modes in order to control the average current and, thus, the voltage slew rate.

The drive control circuit 20 further includes control logic 30 for receiving the output of AND logic gate U7. The control logic 30 may include software executed by the microprocessor and memory 16. In addition, the control logic 30 receives various inputs from the microprocessor and memory 16, or alternately from discrete circuitry. These inputs include a charge voltage threshold $V_C$, a discharge voltage threshold $V_D$, and a charge/discharge signal C/D. The control logic 30 further receives an output of a differential amplifier U1 which senses the voltage potential across the positive and negative terminals (+) and (−) of the injector 12 so as to determine the voltage difference $V_{INJ}$ across the piezoelectric fuel injector 12. The control logic 30 processes the inputs as described herein and generates control signals to control each of switches Q1–Q4.

The drive circuit 20 operates in a discharge mode to open the fuel injector 12 and in a charge mode to close the fuel injector 12. In order to discharge the injector 12, switches Q3 and Q2 are activated to allow current to flow from the high voltage supply across capacitor C1 through switch Q3, inductor L1, injector 12, switch Q2, and sense resistor R1 to ground. The current $I_{CHARGE}$ or $I_{DISCHARGE}$ flowing through the drive circuit 20 is monitored by differential amplifier U2 and, as soon as the peak current threshold $I_P$ is reached, comparator U3 triggers the one shot circuit U6 to initiate a forced off time. At this point, switches Q2 and Q3 are turned off and the current buildup $I_{L1}$ in inductor L1 is recirculated through recirculation diodes D1 and D4 in a recirculation phase.

The direction of the current flow through the inductor L1 and the injector 12 does not change with the recirculation phase. However, during the recirculation phase in the discharge mode, current flows from ground through sense resistor R1, recirculation diode D4, inductor L1, injector 12, recirculation diode D1 and into the capacitor C1 where energy in inductor L1 is transferred to capacitor C1 and made available for the next charge or discharge cycle. Because the injector 12 is in series with inductor L1 in bidirectional current path 26, energy is also transferred from injector 12 to capacitor C1 during the recirculation phase. This recirculation phase represents the energy recovery portion of the discharge and charge events and serves to recover energy from the injector 12 for storage in capacitor C1. The forced off time generated by one shot circuit U6 allows the current sensing circuitry time to adjust to the current reversal occurring in the sense resistor R1 during the transition from current buildup to current recirculation. The current sensing circuitry monitors the recirculation current and, when the absolute value of the recirculation current drops below the recirculation current threshold $I_R$, comparator U4 turns switches Q2 and Q3 on to continue the discharge process.

Differential amplifier U1 monitors the voltage $V_{INJ}$ across the injector 12, and the cycling of current buildup and recirculation proceeds until the H-bridge control logic 30 detects that the appropriate discharge voltage threshold VD has been achieved. The monitored voltage $V_{INJ}$ across the injector 12 is compared to the charge voltage threshold $V_C$ or discharge voltage threshold $V_D$. It should be appreciated that the charge voltage threshold $V_C$ and discharge voltage threshold $V_D$ can be varied to optimize operation over a wide range of engine operating points.

In lieu of the differential amplifier circuitry U1 and U2, it should be appreciated that the microprocessor could monitor the injector voltage and current directly. It should also be appreciated that the charge cycle operation, which causes the injector to close, is similar to the discharge operation as explained above, except that during the charge mode current flows through switches Q1 and Q4 during current buildup, and through recirculation diodes D2 and D3 during the recirculation phase.

Figure 3A:
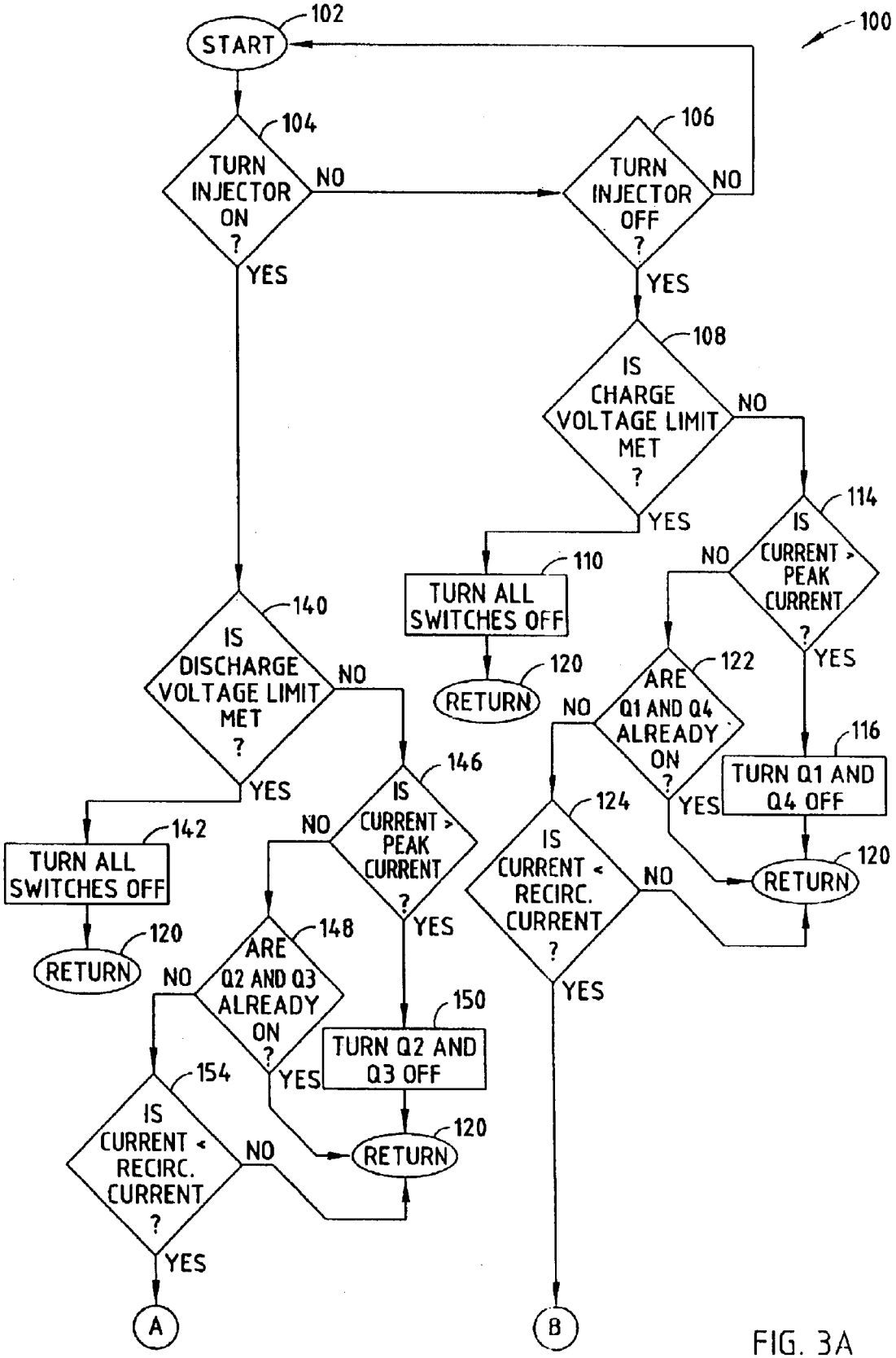
FIGS. 3A and 3B are a flow diagram illustrating a control routine for operating the drive circuit of FIG. 2.
Figure 3B:
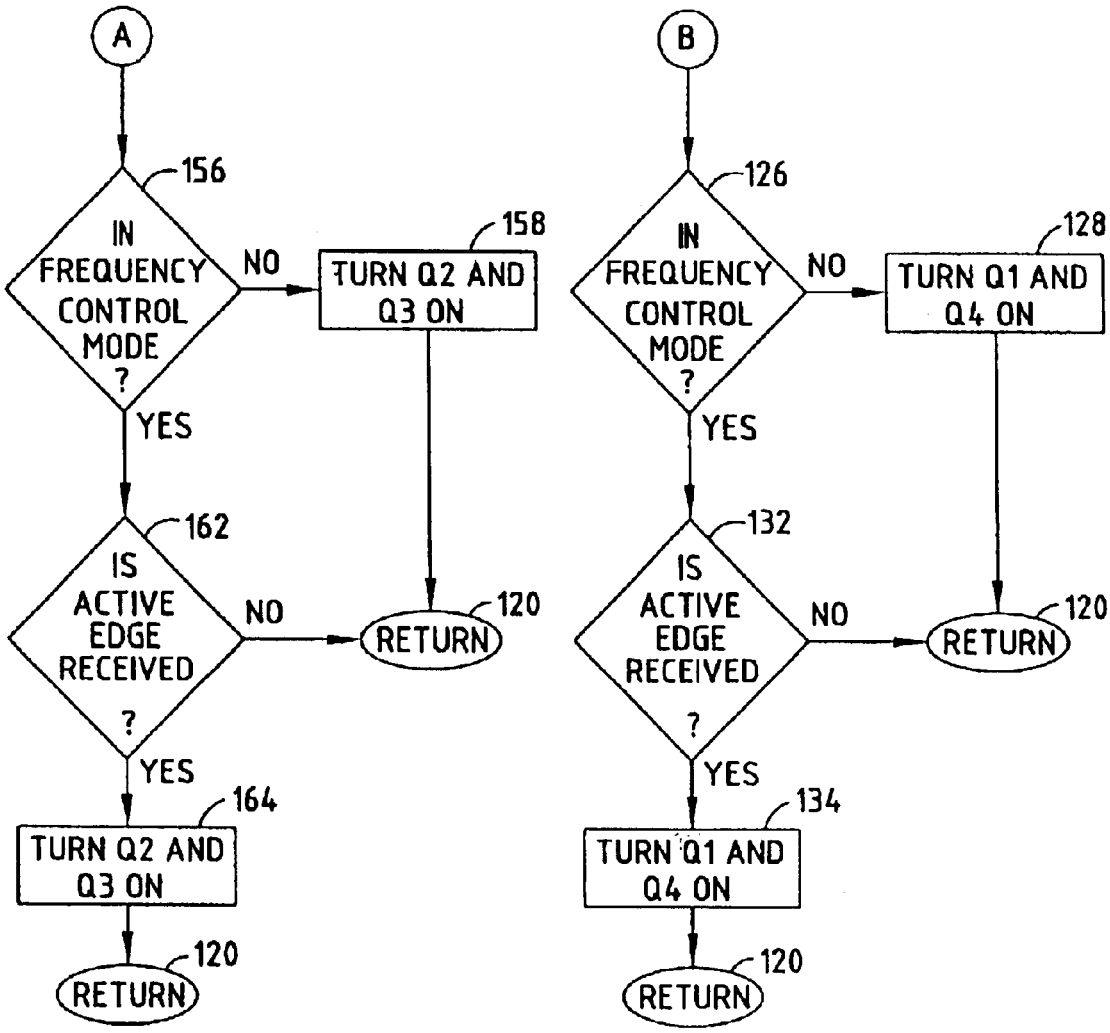

Referring to FIGS. 3A and 3B, a control routine (method) 100 for performing control logic is illustrated for controlling operation of the piezoelectric fuel injector in accordance with the first embodiment of the present invention. The control routine 100 begins at step 102 and checks in decision step 104 if there is a request by the engine control module to turn on the piezoelectric fuel injector. If there is a request to turn on the injector, routine 100 proceeds to decision step 140 to operate the drive circuit in the discharge mode. If not, routine 100 checks if there is a request by the engine control module to turn off the injector in decision step 106 and, if not, returns to the beginning in step 102. If there is a request to turn the injector off, routine 100 proceeds to decision step 108 to operate the drive circuit in the charge mode.

In the charge mode, decision step 108 checks if the charge voltage limit (threshold $V_C$) across the piezoelectric fuel injector has been met. This is determined by comparing the output of differential amplifier U1 with the charge voltage threshold $V_C$. If the charge voltage limit has been met, indicative of the injector being closed, all switches Q1–Q4 are turned off in step 110, before returning to the beginning of the routine 100 in step 120. If the charge voltage limit has not yet been met, routine 100 proceeds to decision step 114 to check if the absolute value of the current sensed across the sense resistor R1 is greater than the peak current threshold $I_P$, as determined by comparator U3.

If the absolute value of the sensed current is greater than the peak current threshold $I_P$, switches Q1 and Q4 are turned off in step 116 before returning to the beginning of the routine 100 in step 120. Once the absolute value of the sensed current exceeds the peak current threshold $I_P$, the switches Q1 and Q4 are turned off and the current flowing through inductor L1 causes energy in inductor L1 and injector 12 to be transferred into capacitor C1 until the absolute value of the sensed current drops below the recirculation current threshold $I_R$. This is achieved by inductor L1 causing current to flow through the injector 12 in a recirculation path by forcing current from ground through sense resistor R1, diode D2, injector 12, inductor L1, diode D3 to the positive terminal of capacitor C1. Thus, energy is recovered during the recirculation phase.

If the absolute value of the sensed current does not exceed the peak current threshold $I_P$, routine 100 proceeds to decision step 122 to check if switches Q1 and Q4 are already turned on and, if so, returns to the beginning of the routine 100 in step 120. If both switches Q1 and Q4 are determined not to be already turned on in step 122, routine 100 determines, in decision step 124, if the absolute value of the current sensed across the sense resistor R1 is less than the recirculation current threshold $I_R$ as determined by comparator U4 and, if not, returns to the beginning in step 120.

If the absolute value of the sensed current is less than the recirculation current threshold $I_R$, control routine 100 proceeds to decision step 126 to determine if the drive circuit is in a frequency control mode in which the frequency control signal is adjusted to set the charge and discharge voltage slew rate. If the frequency control mode is not in operation, switches Q1 and Q4 are turned on in step 128 before returning to the beginning of routine 100 in step 120. By turning on switches Q1 and Q4, control routine 100 causes charge current $I_{CHARGE}$ to continue to flow from the high voltage energy storage capacitor C1 through switch Q1, injector 12, inductor L1, switch Q4, and through sense resistor R1 to ground. In the drive circuit, by closing switches Q1 and Q4, a charge current $I_{CHARGE}$ flows through the inductor L1 and injector 12 in the bidirectional current path 26 to cause the piezoelectric fuel injector 12 to close to prevent the injection of fuel into the engine. Once the fuel injector is closed, it remains closed until the drive circuit is controlled to generate discharge current $I_{DISCHARGE}$ when the fuel injector is requested to be open to inject fuel into the engine. It should be appreciated that switches Q1 and Q4 will be cycled on and off simultaneously for as long as it takes to close the fuel injector, and that multiple cycles of turning switches Q1 and Q4 on and off simultaneously may be performed to achieve this function.

In the frequency control mode of operation, control routine 100 determines if an active edge of the frequency cycle is received in decision step 132 and, if not, returns in step 120. If an active edge is detected in decision step 132, routine 100 proceeds to turn switches Q1 and Q4 on at that time in step 134, before returning in step 120. Accordingly, the frequency control mode waits for an active edge before turning the switches Q1 and Q4 on. By selecting the appropriate frequency of the frequency control signal, changes in the charge and discharge voltage slew rate can be effected. It should also be appreciated that changes in the charge and discharge voltage slew rate may also be achieved by varying the recirculation current threshold $I_R$ and peak current threshold $I_P$.

Returning to decision step 104, control routine 100 proceeds to decision step 140 if the injector is requested to be on and checks for whether the discharge voltage limit (threshold $V_D$) has been met. If the discharge voltage limit $V_D$ has been met, indicative of the injector being open, routine 100 proceeds to turn off all switches Q1–Q4 in step 142 before returning in step 120.

If the discharge voltage limit $V_D$ has not been met in step 140, control routine 100 checks in decision step 146 if the absolute value of the current sensed at the sensing resistor is greater than the peak current threshold $I_P$, as determined by comparator U3. If the absolute value of the sensed current is greater than the peak current threshold $I_P$, switches Q2 and Q3 are turned off in step 150 before returning to the beginning of the routine 100 in step 120. If the absolute value of the sensed current is not greater than the peak current threshold $I_P$, decision step 148 checks whether switches Q2 and Q3 are already on and, if so, returns to the beginning in step 120. If switches Q2 and Q3 are not on, routine 100 proceeds to decision step 154 to check if the absolute value of the sensed current is less than the recirculation current threshold $I_R$, as determined by comparator U4 and, if not, returns to the beginning in step 120.

If the absolute value of the sensed current is less than the recirculation current threshold $I_R$, control routine 100 proceeds to decision step 156 to determine if the frequency control mode is in effect. If the frequency control mode is in operation, decision step 162 checks if an active edge of the frequency control signal has been received and, if not, returns in step 120. If an active edge has been received, switches Q2 and Q3 are turned on in step 164 before returning in step 120. Absent the frequency control mode, routine 100 turns switches Q2 and Q3 on in step 158 before returning in step 120. It should be appreciated that the frequency control mode allows for the charge and discharge voltage slew rate to be varied by varying the frequency of the frequency control signal.

By turning switches Q2 and Q3 on, current is caused to flow from the high voltage energy storage capacitor C1 through switch Q3, inductor L1, injector 12, switch Q2, and sense resistor R1 to ground. This provides for a discharge current $I_{DISCHARGE}$ flowing through the injector 12 and inductor L1 in the bidirectional current path 26. The discharge current $I_{DISCHARGE}$ causes the fuel injector 12 to open to allow fuel to be injected into the engine.

In the discharge mode, the drive circuit 20 is controlled to apply voltage to the negative terminal of the fuel injector 12 in a manner that limits the rate of change of current flowing through the injector 12 by way of the current-limiting inductor L1. When the absolute value of the sensed current exceeds the peak current threshold $I_P$, switches Q2 and Q3 are turned off until the absolute value of the sensed current drops below the recirculation current threshold $I_R$. During this time period, current is allowed to flow back into capacitor C1 during a recirculation phase to transfer energy in inductor L1 and injector 12 to capacitor C1. When the absolute value of the sensed current drops below the recirculation current threshold $I_R$, switches Q2 and Q3 are turned on to allow discharge current to again flow to the negative terminal of the injector 12. This cycling of current $I_{DISCHARGE}$ and recirculation current is repeated until the discharge voltage limit $V_D$ is met, at which time the injector 12 is fully open. The fuel injector 12 remains fully open, until the drive circuit 20 charges the fuel injector 12 when a request for closing the fuel injector 12 is made.

Figure 4A:
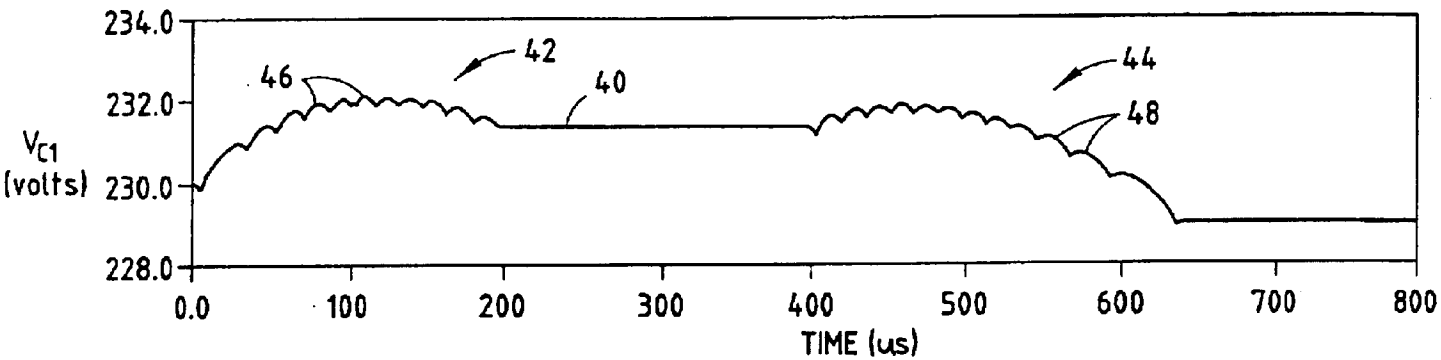
FIGS. 4A–4C are graphs which illustrate voltage and current levels during operation of the drive circuit of FIG. 2, according to one example.
Figure 4B:
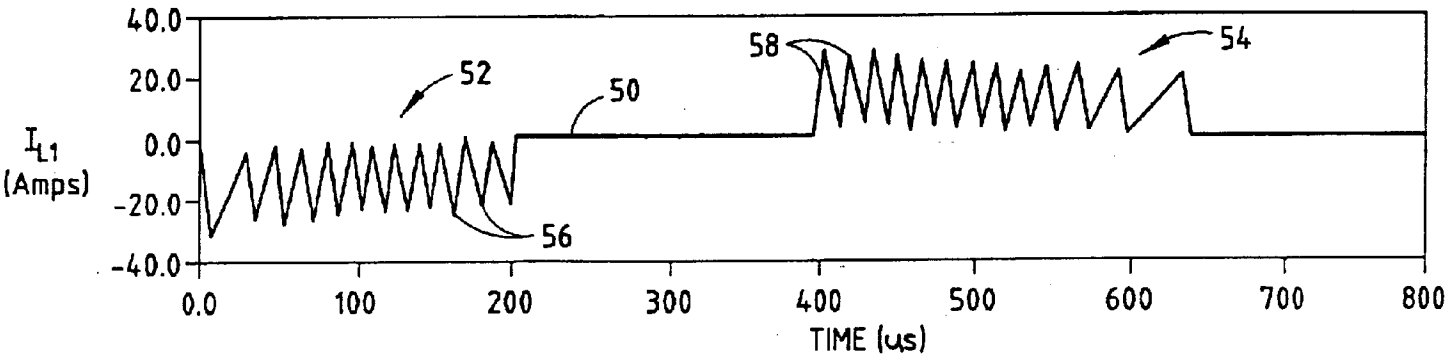
Figure 4C:
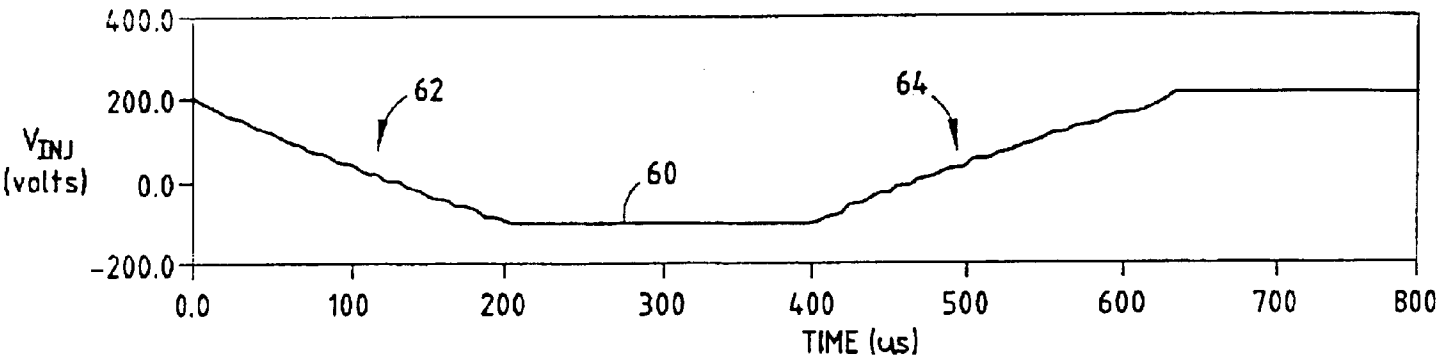

Referring to FIGS. 4A–4C, the voltage $V_{C1}$ across capacitor C1, current $I_{L1}$ through inductor L1, and the charge/discharge voltage $V_{INJ}$ across the injector 12 are illustrated during both discharge and charge modes to open and close the piezoelectric fuel injector, according to one example. The voltage $V_{C1}$ across capacitor C1, shown by line 40 in FIG. 4A, is shown increasing via waveform 42 having spikes 46 during the discharge mode, and decreasing via waveform 44 having spikes 48 during the charge mode. The inductor current $I_{L1}$, shown by line 50 in FIG. 4B, is shown ramping down to approximately minus twenty amps (−20 A) during current buildup and decaying back to about zero amps during the recirculation phase as shown by spikes 56 of waveform 52 during the discharge mode. During the charge mode, current $I_{L1}$ increases from about zero amps to approximately twenty amps (+20 A) during current buildup and then ramps back down to approximately zero amps during the recirculation phase, as shown by spikes 58 of waveform 54. The spikes 56 and 58 of current $I_{L1}$ occur for as long as the voltage $V_{C1}$ is applied to discharge or charge the injector voltage $V_{INJ}$ as shown in FIG. 4C. The injector voltage $V_{INJ}$ shown by line 60 in FIG. 4C, shows the voltage of the injector decreasing in waveform 62 during a discharge mode and increasing in waveform 64 during a charge mode. The voltage slew rate (slope) of waveform 62 or 64 can be adjusted by varying the frequency of the frequency control signal or the peak and/or recirculation current thresholds $I_P$ and $I_R$. The higher the voltage slew rate, generally the faster the fuel injector will be opened and closed. However, it should be appreciated that the rate of opening and closing the fuel injector may be varied to enhance engine operation over a wide range of engine speed/load points.

Accordingly, the drive circuit 20 of the present invention advantageously controls the operation of a piezoelectric fuel injector 12 by controlling the current through the fuel injector 12 via a current-limiting inductor L1 in series with the injector 12. The drive circuit 20 recirculates energy stored in the injector 12 back into an energy storage capacitor C1 so as to provide for an enhanced circuit arrangement. In addition, the drive circuit 20 allows for adjustment of the voltage slew rate for charging and discharging the injector 12 which allows for enhanced operation over a wide range of engine operating characteristics (e.g., engine speed, load, etc.). Further, the charge voltage threshold $V_C$ and discharge voltage threshold $V_D$ can also be varied to optimize engine operation.

Figure 5:
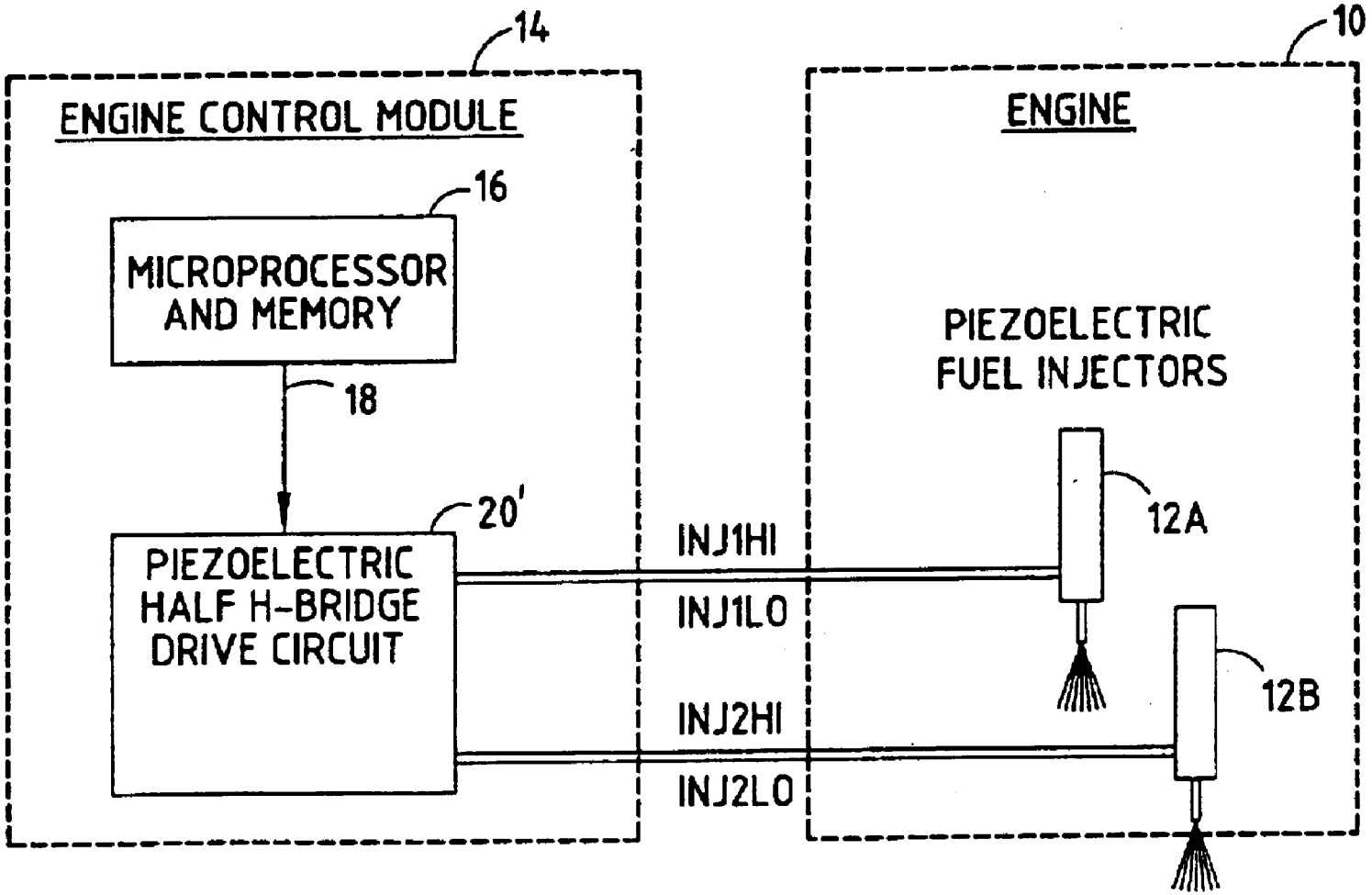
FIG. 5 is a block diagram illustrating a second embodiment of a drive circuit controlling two piezoelectric fuel injectors in an engine according to the present invention.
Figure 6:
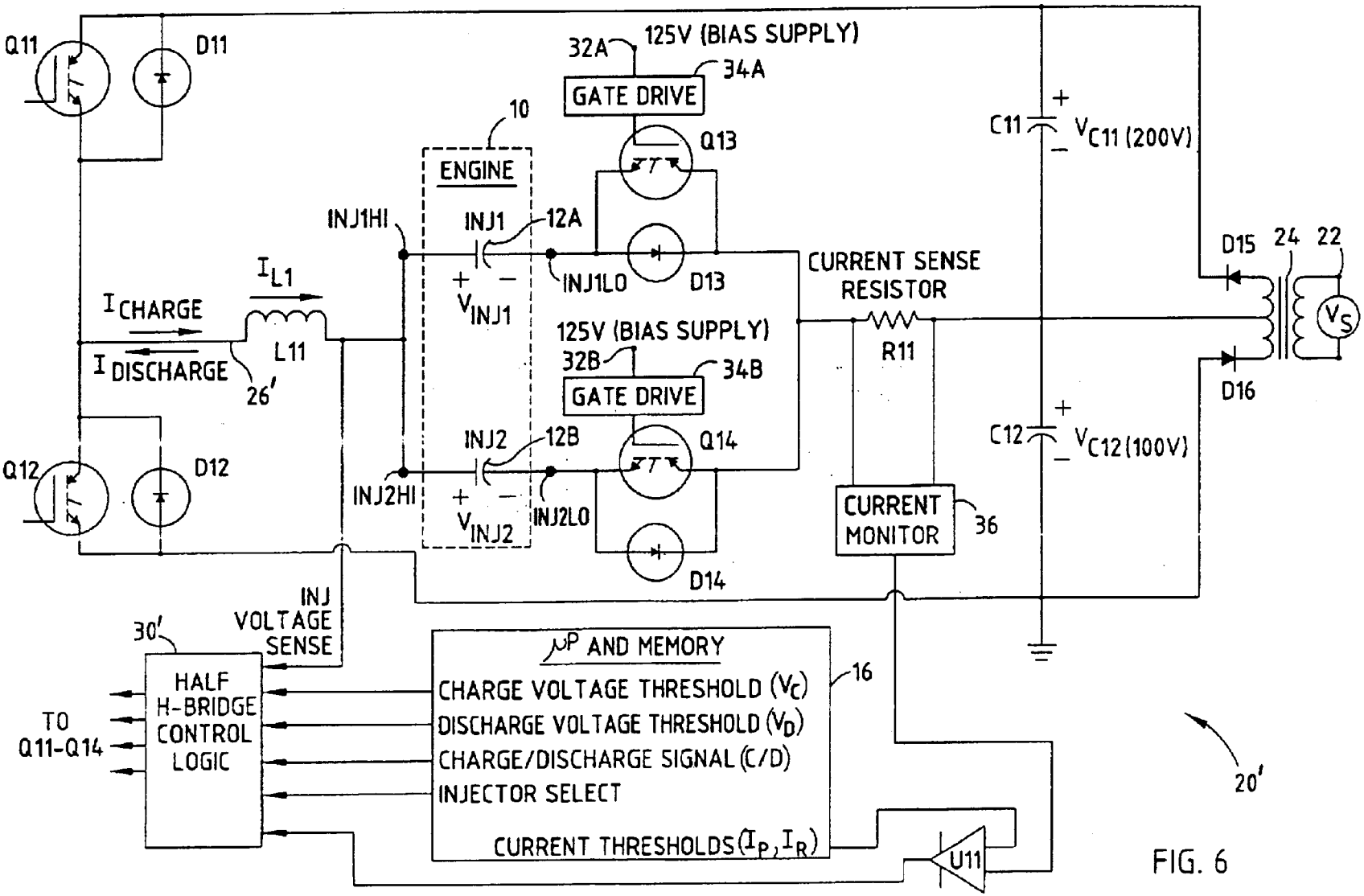
FIG. 6 is a block/circuit diagram illustrating the piezoelectric drive circuit according to the second embodiment of the present invention.

Referring to FIGS. 5 and 6, a piezoelectric drive circuit 20' is shown according to a second embodiment of the present invention. The piezoelectric drive circuit 20' employs a half H-bridge configuration, in contrast to the full H-bridge configuration of the drive circuit 20 described above in the first embodiment. Drive circuit 20' is shown as part of the engine control module 14 and receives control signals 18 from microprocessor and memory 16. Alternately, drive circuit 20' may be located external to the engine control module 14 and may employ a separate microprocessor. With particular reference to FIG. 5, the drive circuit 20' controls the opening and closing of two piezoelectric fuel injectors 12A and 12B to meter and inject precise amounts of fuel into the individual cylinders or intake manifold of engine 10. While two piezoelectric fuel injectors 12A and 12B are shown and described in connection with drive circuit 20' according to the second embodiment, it should be appreciated that the engine 10 may include one or more piezoelectric fuel injectors, all of which could be controlled by the drive circuit 20'.

The second embodiment of the piezoelectric drive circuit 20' is illustrated in detail in the block/circuit diagram of FIG. 6. The drive circuit 20' in the second embodiment generally is configured as a half H-bridge having a middle circuit branch 26' that serves as a bidirectional current path. The middle circuit branch 26' includes an inductor L11 coupled in series with a parallel connection of piezoelectric fuel injectors 12A and 12B (INJ1 and INJ2) and corresponding switching circuitry, and a sense resistor R11. The drive circuit 20' includes a voltage input 22 for receiving a voltage $V_S$ (e.g., 12 volts) from a voltage source (e.g., vehicle battery). The voltage $V_S$ is increased to a higher step-up voltage $V_{C11}$ (e.g., 200 volts) via a step-up transformer (DC-to-DC converter) 24 or other voltage step-up device. The step-up voltage $V_{C11}$ is applied to a first energy storage capacitor C11 via diode D15. The step-up voltage $V_{C11}$ applied to capacitor C11 may provide a high voltage such as 200 volts, according to one example. The step-up transformer 24 also provides a voltage $V_{C12}$ to a second energy storage capacitor C12 of about 100 volts, according to one example. The step-up transformer 24 has a return line coupled to diode D16.

The drive circuit 20' includes switches Q11 and Q12 for controlling the charge and discharge operations of injectors 12A and 12B. According to one embodiment, switches Q11 and Q12 may each include an N-channel insulated gate bi-polar transistor (IGBT) having a gate controlling current flow from the collector to the emitter. Each of switches Q11 and Q 12 allows for unidirectional current flow from the collector to the emitter when turned on, and prevents current flow when turned off. Connected in parallel to each of switches Q11 and Q12 are recirculation diodes D11 and D12, respectively, for providing unidirectional current flow opposite to the direction of current flow of the corresponding switches Q11 and Q12. Recirculation diodes D11 and D12 allow recirculation current to return to energy storage capacitor C11 or C12 during the energy recovery mode.

Connected in series with each of piezoelectric fuel injectors 12A and 12B is switching circuitry for selecting the appropriate one of piezoelectric fuel injectors 12A and 12B during the current discharge operation. The switching circuitry associated with injector 12A includes a unidirectional switch Q13 having a gate coupled to gate drive 34A which is powered at a bias supply input 32A by 125 volts, according to one example. The unidirectional switch Q13 may include an N-channel insulated gate bi-polar transistor (IGBT) which, when turned on, allows current flow only in the discharge direction. A diode D13 is connected in parallel with switch Q13 to allow current flow in the charge direction.

The switching circuitry associated with piezoelectric fuel injector 12B likewise includes a unidirectional switch Q14 having a gate coupled to a gate driver 34B and bias supply input 32B for receiving 125 volts, according to one example. The unidirectional switch Q14 likewise may include an N-channel insulated gate bi-polar transistor (IGBT) which, when turned on, allows current flow only in the discharge direction. A diode D14 is coupled in parallel with switch Q14 to allow current flow in the charge direction.

The sense resistor R11 is connected within the bidirectional current path 26'. Coupled to both terminals of sense resistor R11 is a current monitor 36 for monitoring the current flow through the sense resistor R11 and, thus, the current flow through bidirectional current path 26'. The output of the current monitor 36 is supplied to a comparator U11 which compares the sensed current with current thresholds $I_P$ and $I_R$ and generates output signals.

The microprocessor and memory 16 provides the current thresholds including the peak current threshold $I_P$ and the recirculation current threshold $I_R$. In addition, microprocessor and memory 16 also provides a charge voltage threshold $V_C$ and a discharge voltage threshold ($V_D$). The microprocessor and memory 16 further provides a charge/discharge signal (C/D), and an injector selector for selecting one of the injectors during the discharge operation. While various thresholds are shown provided by the microprocessor and memory 16, it should be appreciated that such signals may alternately be provided with discrete circuitry.

The drive control circuit 20' includes control logic 30' for receiving the output of comparator U11, a sensed voltage from the positive terminal (+) of the injectors 12A and 12B, and the various output signals provided from the microprocessor and memory 16. The control logic 30' may include software executed by the microprocessor and memory 16. The control logic 30' processes the various inputs as described herein and generates control signals to control each of switches Q11 through Q14.

The drive circuit 20' of the second embodiment operates in a discharge mode to open a select one of the fuel injectors 12A and 12B and in a charge mode to close the fuel injectors 12A and 12B. It should be appreciated that the drive circuit 20' may alternately be configured to operate in a charge mode to open a select one of the fuel injectors 12A and 12B and in a discharge mode to close the fuel injectors 12A and 12. In order to operate in the discharge mode, switch Q12 is activated and one of switches Q13 and Q14 is also activated to select one of injectors 12A and 12B, respectively. Activation of switch Q12 allows current to flow from the 100 volt power supply across capacitor C12 through the current sense resistor R11, through the selected one of switches Q13 and Q14, and into the corresponding negative side of the selected injector 12A or 12B. The discharge current $I_{DISCHARGE}$ flows from the injector load through the inductor L11, through switch Q12 and back to the negative terminal of capacitor C12. The current sense circuitry (circuit monitor 36 and comparator U11) monitors the current buildup, and as soon as the peak current threshold $I_P$ (which could be adjustable) is reached, comparator U11 shuts off switch Q12. At this point, the current that is built up in inductor L11 recirculates through diode D11. As a consequence, the direction of current flow through the inductor L11 and the selected one of the injectors 12A and 12B does not change.

During the recirculation phase, current flows from the negative side of the 200 volt power supply across capacitor C11, through the current sense resistor R11, through the selected one of switches Q13 and Q14, through the selected injector load 12A or 12B, through the inductor L11, and finally through diode D11 and into the positive side of capacitor C11. During this recirculation phase, energy from the inductor L11 and the selected one of the piezoelectric injectors 12A or 12B is transferred to capacitor C11 for energy storage therein. The current sense circuitry monitors the recirculation current, and when the recirculation current has fallen below the recirculation current threshold $I_R$ (which may be adjustable), comparator U11 reactivates switch Q12 to continue the discharge operation. The voltage $V_{INJ1}$ or $V_{INJ2}$ across the selected injector 12A or 12B is also monitored, and the cycle of current buildup and recirculation continues until the appropriate discharge voltage level (threshold $V_D$) (which may be adjustable) has been achieved. In this discharge cycle, the capacitor C12 provides energy, while capacitor C11 receives energy for storage. Once the appropriate discharge voltage threshold $V_D$ is achieved, the half H-bridge drive circuit 20' is deactivated until a charge cycle is initiated, or until it is determined that additional discharge pulses are required to maintain the desired injector voltage.

In order to charge (close) the injectors 12A and 12B, switch Q11 is activated, thus allowing current to flow from the 200 volt power supply across capacitor C11 through the inductor L11 and into the positive side of the injectors 12A and 12B. The charge current $I_{CHARGE}$ flows through the injectors 12A and 12B, through diodes D13 and D14, through the current sense resistor R11, and back to energy storage capacitor C11. It should be appreciated that a majority of the charge current $I_{CHARGE}$ will flow through the previously discharged injector. The remaining injector that was not previously discharged will receive current if the corresponding voltage $V_{INJ1}$ or $V_{INJ2}$ has dropped below the charge voltage threshold $V_C$. The current sense circuitry monitors the current buildup, and as soon as the peak current threshold $I_P$ (which may be adjustable) is reached, comparator U11 shuts off switch Q11. At this point, the current that is built up in inductor L11 recirculates through diode D12. Thus, the direction of current flow through the inductor L11 and injectors 12A and 12B does not change.

During the recirculation phase, current flows from the negative side of the 100 volt power supply across capacitor C12, through diode D12, through the inductor L11 and the injectors 12A and 12B, through diodes D13 and D14, and sense resistor R11, and into the positive side of energy storage capacitor C12. During this recirculation phase, energy from the inductor L11 is transferred to piezoelectric injectors 12A and 12B and to energy storage capacitor C12. The current sense circuitry monitors the recirculation current, and when the recirculation current has fallen below the recirculation current threshold $I_R$ (which may be adjustable), comparator U11 reactivates switch Q11 to continue the charge process. The voltage across the injectors 12A and 12B is monitored, and the cycle of current buildup and recirculation continues until the appropriate charge voltage level (threshold $V_C$) (which may be adjustable) has been achieved. In this charge cycle, energy storage capacitor C11 provides energy, and energy storage capacitor C12 receives energy for storage. Once the appropriate charge voltage threshold $V_C$ is achieved, the half H-bridge drive circuit 20 is deactivated until a discharge cycle is initiated, or until it is determined that additional charge pulses are required to maintain the desired injector voltage.

The opening and closing characteristics of the piezoelectric injectors 12A and 12B are influenced by the voltage slew rate applied during the discharge and charge cycles, respectively. To vary the voltage slew rate, the average current flowing through the injector 12A and 12B is changed. This may be accomplished by changing the peak and/or recirculation current thresholds $I_P$ and $I_R$. Additionally, a microprocessor analog-to-digital (A/D) channel can be used to monitor the voltage at the injectors, which may facilitate changes to the charge and discharge voltage targets. Upper and lower current thresholds can be varied through the use of digital or analog outputs that change the reference voltage provided to the current comparator U11. Further, in lieu of current monitor 36 and comparator U11, it should be appreciated that the microprocessor and memory 16 could monitor the injector current, as well as injector voltage directly.

Figure 7A:
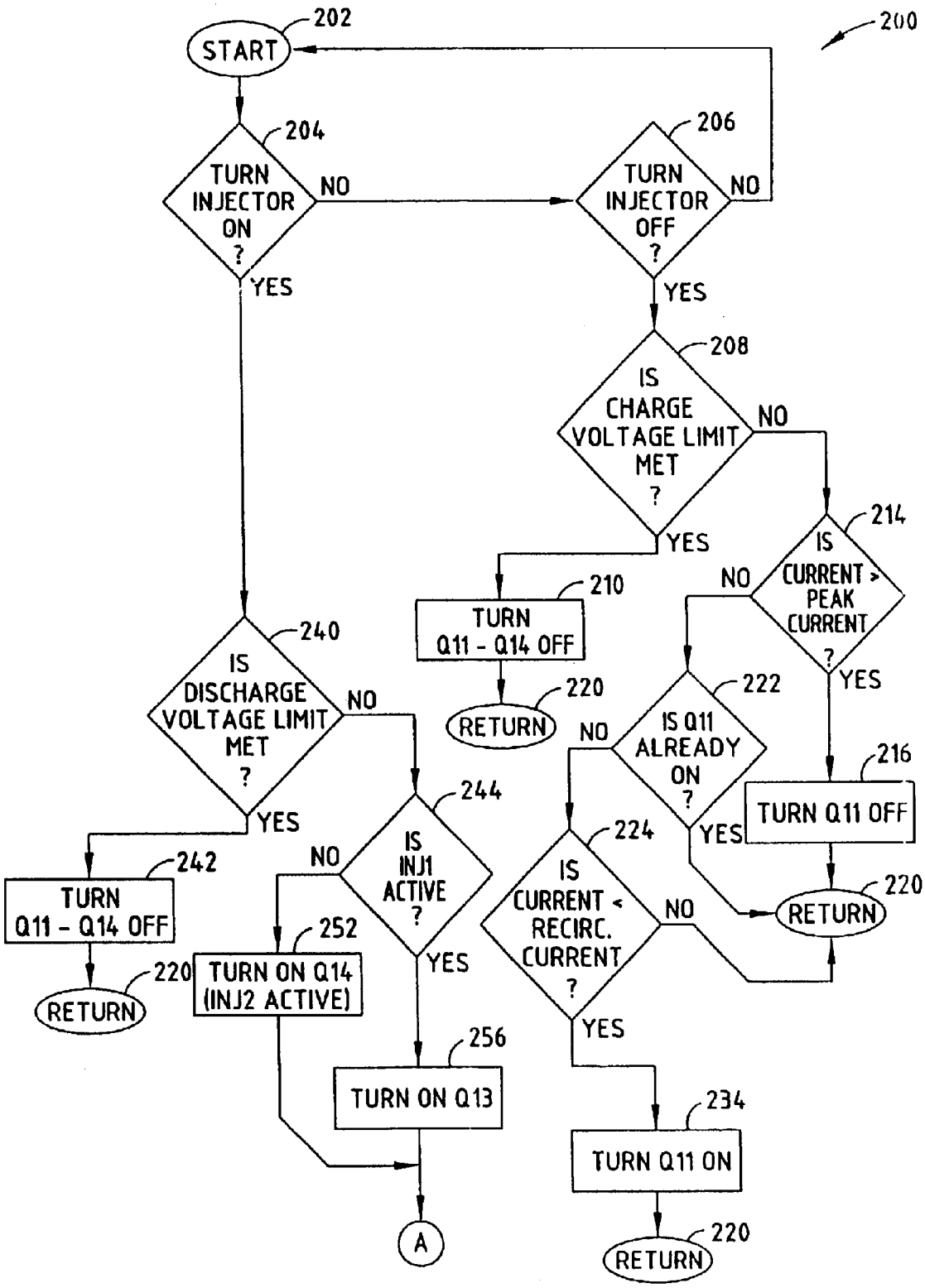
FIGS. 7A and 7B are a flow diagram illustrating a control routine for operating the drive circuit of FIG. 6.
Figure 7B:
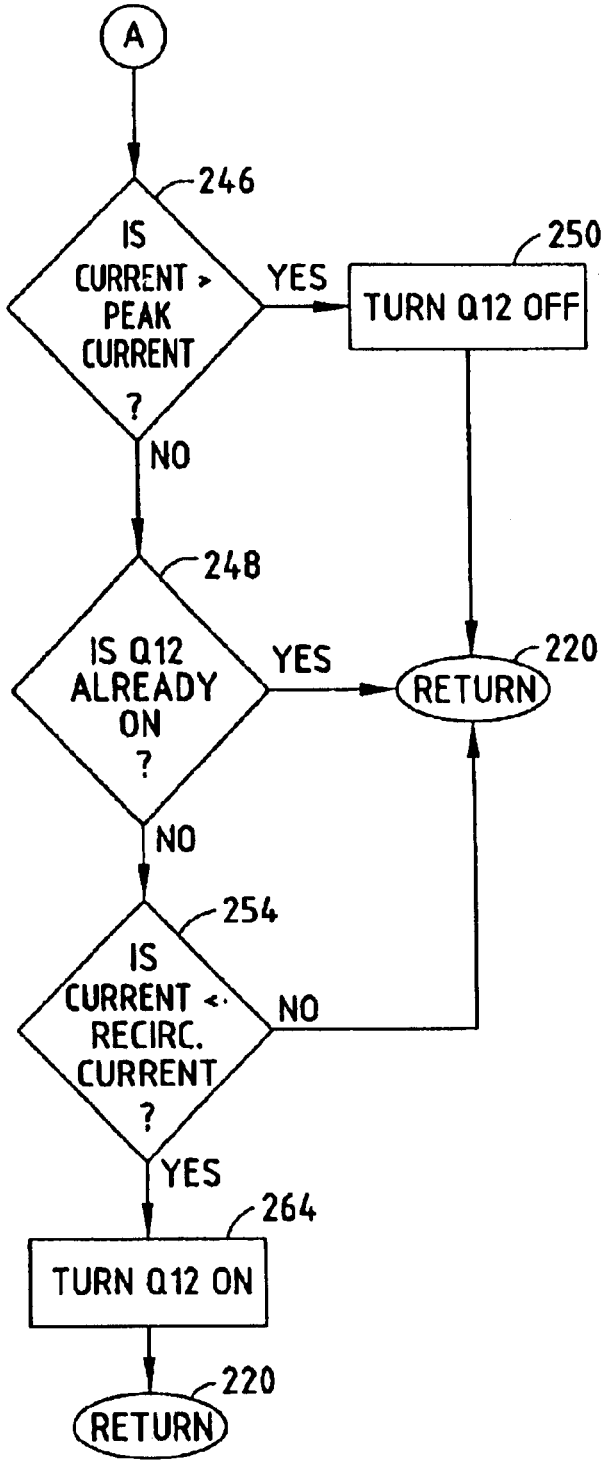

Referring to FIGS. 7A and 7B, a control routine 200 for performing control logic is illustrated for controlling operation of the piezoelectric fuel injectors 12A and 12B with the drive circuit 20' according to the second embodiment of the present invention. The control routine 200 begins at step 202 and checks in decision step 204 if there is a request by the engine control module to turn on one of the fuel injectors. If there is a request to turn on one of the injectors, routine 200 proceeds to decision step 240 to operate the drive circuit in the discharge mode. If not, routine 200 checks if there is a request by the engine control module to turn off the fuel injectors in decision step 206 and, if not, returns to the beginning in step 202. If there is a request to turn the fuel injectors off, routine 200 proceeds to decision step 208 to operate the drive circuit in the charge mode.

In the charge mode, routine 200 in decision step 208 checks if the charge voltage limit (threshold $V_C$) across each of the fuel injectors has been met. This is determined by comparing the voltage sensed at the positive terminal of the injectors with the charge voltage threshold $V_C$. If the charge voltage limit has been met, indicative of the injectors being closed, all switches Q11 through Q14 are turned off in step 210 before returning to the beginning of routine 200 in step 220. If the charge voltage limit has not yet been met, routine 200 proceeds to decision step 214 to check if the absolute value of the current sensed across the sense resistor R11 is greater than the current threshold $I_P$, as determined by comparator U11.

If the absolute value of the sensed current is greater than the peak current threshold $I_P$, switch Q11 is turned off in step 216 before returning to the beginning of routine 200 in step 220. Once the absolute value of the sensed current exceeds the peak current threshold $I_P$, switch Q11 is turned off and the current flowing through inductor L11 causes energy in inductor L11 and injectors 12A and 12B to be transferred into storage capacitor C12 until the absolute value of the sensed current drops below the recirculation current threshold $I_R$. This is achieved by inductor L11 causing current to flow through injectors 12A and 12B in a recirculation path by forcing current from ground through diode D12, inductor L11, injectors 12A and 12B, diodes D13 and D14, and sense resistor R11 into energy storage capacitor C12. Thus, energy is recovered during the recirculation phase.

If the absolute value of the sensed current does not exceed the peak current threshold $I_P$, routine 200 proceeds to decision step 222 to check if switch Q11 is already on and, if so, returns to the beginning of the routine 200 in step 220. If switch Q11 is determined not to be already turned on in step 222, routine 200 determines, in decision step 224, if the absolute value of the current sensed across the sense resistor R11 is less than the recirculation current threshold $I_R$ as determined by comparator U11 and, if not, returns to the beginning in step 220. If the absolute value of the sensed current is less than the recirculation current threshold $I_R$, control routine 200 proceeds to turn switch Q11 on in step 234, before returning in step 220.

By turning switch Q11 on, current is caused to flow from the energy storage capacitor C11 through switch Q11, inductor L11, injectors 12A and 12B, diodes D13 and D14, sense resistor R11 and returning to the negative terminal of capacitor C11. This provides for a charge current $I_{CHARGE}$ flowing through injectors 12A and 12B and inductor L11 in bidirectional current path 26'. The charge current $I_{CHARGE}$ causes the fuel injector previously discharged to charge (close) and the remaining fuel injector(s) to remain charged (closed).

In the charge mode, the drive circuit 20' is controlled to apply voltage to the positive terminal of the fuel injectors 12A and 12B in a manner that limits the rate of change of current flowing through the injectors 12A and 12B by way of the current-limiting inductor L11. When the absolute value of the sensed current exceeds the peak current threshold $I_P$, switch Q11 is turned off until the absolute value of the sensed current drops below the recirculation current threshold $I_R$. In this time period, current is allowed to flow back into capacitor C12 during a recirculation phase to transfer energy in inductor L11 and injectors 12A and 12B to energy storage capacitor C12. When the absolute value of the sensed current drops below the recirculation current threshold $I_R$, switch Q11 is turned on to allow charge current to again flow to the positive terminal of the injectors 12A and 12B. The cycling of the current $I_{CHARGE}$ and recirculation current is repeated until the charge voltage threshold $V_C$ is met, at which time the injectors 12A and 12B are fully closed. The fuel injectors 12A and 12B remain fully closed until the drive circuit 20' discharges a selected one of the fuel injectors 12A and 12B when a request for opening a selected one of the fuel injectors 12A and 12B is made.

Returning to decision step 204, control routine 200 proceeds to decision step 240 during the discharge mode when one of the injectors is required to be turned on (discharged) and checks for whether the discharge voltage limit (threshold $V_D$) has been met. If the discharge voltage threshold $V_D$ has been met, indicative of one of the injectors being open, routine 200 proceeds to turn off all switches Q11 through Q14 in step 242 before returning in step 220.

If the discharge voltage threshold $V_D$ has not been met in step 240, control routine 200 checks in decision step 244 if the first fuel injector INJ1 12A is in an active state to be turned on and, if so, switch Q13 is turned on in step 256. If it is determined that the first injector INJ1 12A is not in an active state, it is assumed that the second injector INJ2 12B is in the active state and, thus, routine 200 turns on switch Q14 in step 252. With one of switches Q13 and Q14 turned on, routine 200 proceeds to decision step 246 to check if the absolute value of the current sensed at the resistor R11 is greater than the peak current threshold $I_P$, as determined by comparator U11. If the absolute value of the sensed current is greater than the peak current threshold $I_P$, switch Q12 is turned off in step 250 before returning to the beginning of routine 200 in step 220. Once the absolute value of the sensed current exceeds the peak current threshold $I_P$, switch Q12 is turned off and the current flowing through inductor L11 causes energy in inductor L11 and the selected one of injectors 12A and 12B to be transferred into storage capacitor C11 until the absolute value of the sensed current drops below the recirculation current threshold $I_R$. This is achieved by inductor L11 causing current to flow through the selected one of injectors 12A and 12B in a recirculation path by forcing current from the negative terminal of capacitor C11 through sense resistor R11, the selected one of switches Q13 and Q14, the selected one of injectors 12A and 12B, inductor L11, diode D11, and returning to the positive terminal of capacitor C11. Thus, energy is recovered during the recirculation phase.

If the absolute value of the sensed current is not greater than the peak current threshold $I_P$, decision step 248 checks whether switch Q12 is already on and, if so, returns to the beginning in step 220. If switch Q12 is not on, routine 200 proceeds to decision step 254 to check if the absolute value of the sensed current is less than the recirculation current threshold $I_R$, as determined by comparator U11 and, if not, returns to the beginning in step 220. If the absolute value of the sensed current is less than the recirculation current threshold $I_R$, control routine 200 proceeds to turn switch Q12 on in step 264 before returning in step 220.

By turning switch Q12 on, current is caused to flow from the energy storage capacitor C12 through sense resistor R11, the selected one of transistors Q13 and Q14 and corresponding injectors 12A and 12B, inductor L11, and switch Q12 to ground. This provides for a discharge current $I_{DISCHARGE}$ flowing through the selected injector 12A or 12B and inductor L11 in the bidirectional current path 26'. The discharge current $I_{DISCHARGE}$ causes the selected one of the fuel injectors 12A and 12B to open to allow fuel to be injected into the engine.

In the discharge mode, the drive circuit 20' is controlled to apply voltage to the negative terminal of the selected one of fuel injectors 12A and 12B in a manner that limits the rate of change of current flowing through the selected one of the injectors 12A and 12B by way of the current-limiting inductor L11. When the absolute value of the sensed current exceeds the peak current threshold $I_P$, switch Q12 is turned off until the absolute value of the sensed current drops below the recirculation current threshold $I_R$. In this time period, current is allowed to flow back into capacitor C11 during a recirculation phase to transfer energy in inductor L11 and a selected one of the injectors 12A and 12B to energy storage capacitor C11. When the absolute value of the sensed current drops below the recirculation current threshold $I_R$, switch Q12 is turned on to allow discharge current to again flow to the negative terminal of the selected one of injectors 12A and 12B. The cycling of the current $I_{DISCHARGE}$ and recirculation current is repeated until the discharge voltage threshold $V_D$ is met, at which time the selected one of the injectors 12A and 12B is fully opened. The selected one of the fuel injectors 12A and 12B remains fully open, until the drive circuit 20' charges the fuel injectors 12A and 12B when a request for closing the selected one of the fuel injectors 12A and 12B is made.

Figure 8A:
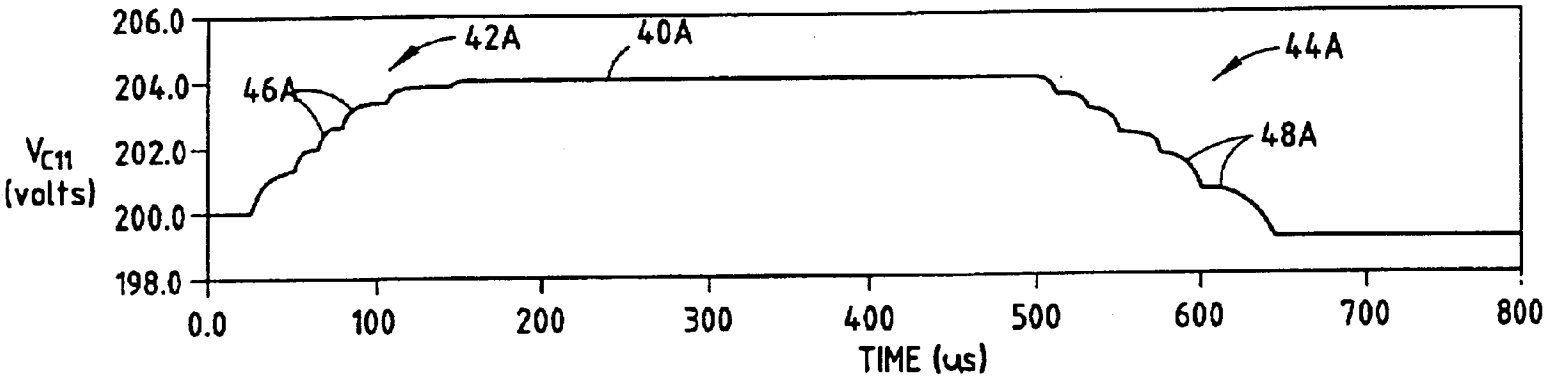
FIGS. 8A–8D are graphs which illustrate voltage and current levels during operation of the drive circuit of FIG. 6, according to one example.
Figure 8B:
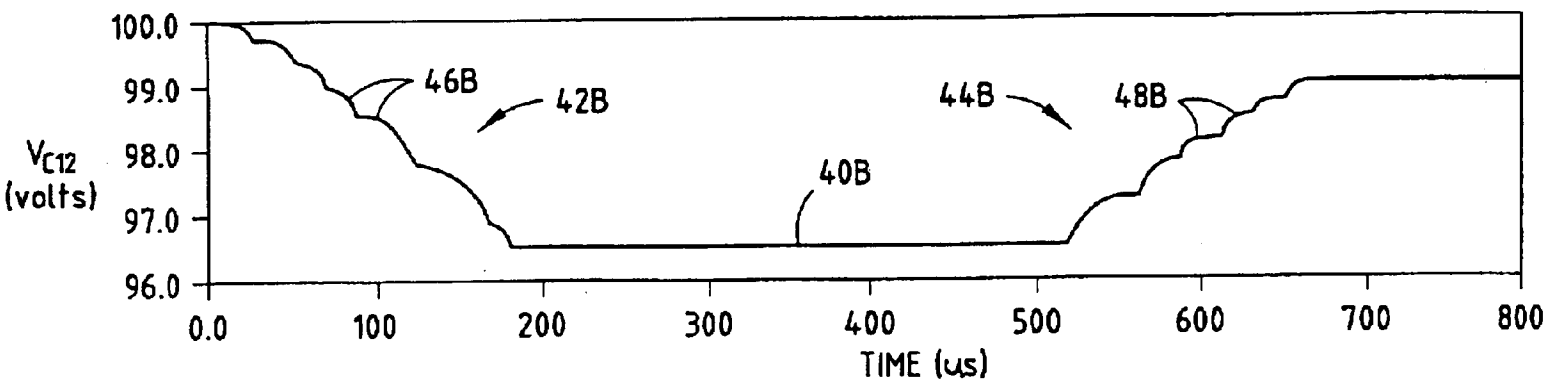
Figure 8C:
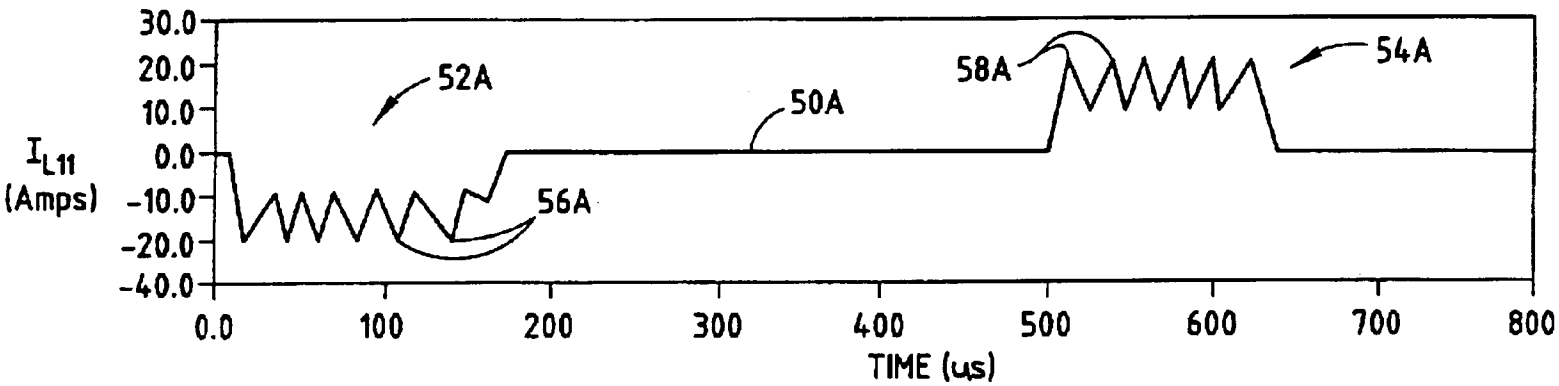
Figure 8D:
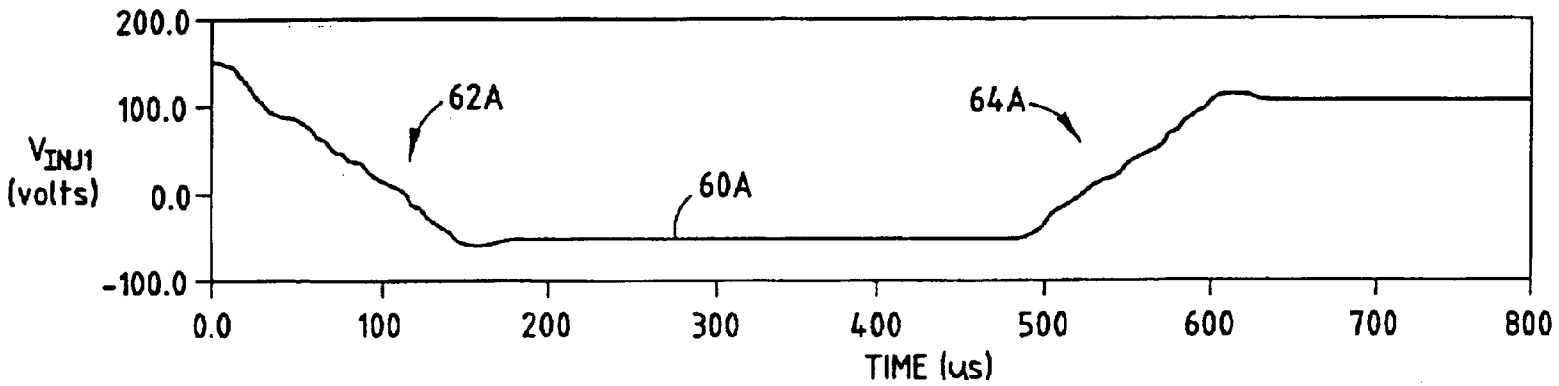

Referring to FIGS. 8A through 8D, the voltage $V_{C11}$ and $V_{C12}$ across capacitors C11 and C12, current $I_{L11}$ through inductor L11, and the charge/discharge voltage $V_{INJ1}$ across the injector 12A are illustrated during both discharge and charge modes to open and close the piezoelectric fuel injector 12A, according to one example. The voltage $V_{C12}$ across capacitor C11, shown by line 40A in FIG. 8A, is shown increasing via waveform 42A having spikes 46A during the discharge mode, and decreasing via waveform 44A having spikes 48A during the charge mode. The voltage $V_{C12}$ across capacitor C12 shown by line 40B in FIG. 8B, is shown decreasing via waveform 42B having spikes 46B during the discharge mode, and increasing via waveform 44B having spikes 48B during the charge mode. The inductor current $I_{L11}$, shown by line 50A in FIG. 8C, is shown ramping down to approximately minus twenty amps (−20 A) during current buildup and decaying back to about minus ten amps (−10 A) during the recirculation phase as shown by spikes 56A of waveform 52A during the discharge mode. During the charge mode, current $I_{L11}$ increases from about zero amps to approximately twenty amps (+20 A) during current buildup and ramps back down to approximately ten amps (+10 A) during the recirculation phase, as shown by spikes 58A of waveform 54A. The spikes 56A and 58A of current $I_{L11}$ occur for as long as the voltage $V_{C12}$ or $V_{C11}$ is applied to discharge or charge the injector voltage $V_{INJ1}$ as shown in FIG. 8D. The injector voltage VINJ1, shown by line 60A in FIG. 8D, shows the voltage $V_{INJ1}$ of the injector 12A decreasing in waveform 62A during a discharge mode and increasing in waveform 64A during a charge mode. The voltage slew rate (slope) of waveform 62A or 64A can be adjusted by varying the peak and/or recirculation current thresholds $I_P$ and $I_R$. The higher the voltage slew rate, generally the faster the fuel injector will be opened and closed. However, it should be appreciated that the rate of opening and closing the fuel injector may be varied to enhance engine operation over a wide range of engine speed/load points.

Accordingly, the half H-bridge drive circuit 20' according to the second embodiment of the present invention advantageously controls operation of one or a plurality of piezoelectric fuel injectors (e.g., 12A and 12B) by controlling current through the fuel injectors 12A and 12B via a current-limiting inductor L11 in a bidirectional current path 26'. The drive circuit 20' recirculates energy stored in the injectors 12A and 12B back into the energy storage capacitors C11 and C12. The drive circuit 20' incorporates selector switching circuitry to advantageously control multiple injectors in a single drive circuit by employing a single bridge structure including a single charge/discharge inductor L11 and switches Q11 and Q12. The topology of the half H-bridge drive circuit 20' may reduce input power draw and lessen the silicon content required for the circuitry, however, the half H-bridge drive circuit 20' may require the use of multiple high voltage supplies. It should be appreciated that the drive circuit 20' may be further adjusted by adjusting voltage slew rate, the charge voltage threshold $V_C$, and the discharge voltage threshold $V_D$, to optimize engine operation.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A drive circuit for a piezoelectric injector, said drive circuit comprising:

a voltage input for receiving a voltage signal;

an energy storage device coupled to the voltage input for storing an electrical charge;

a bidirectional current path coupled to a piezoelectric injector;

an inductor coupled in series with the piezoelectric injector in the bidirectional current path; and switching circuitry for controlling current flow through the piezoelectric injector and the inductor to open and close the piezoelectric injector, wherein the switching circuitry is controlled to provide a recirculation current to recover energy stored in the piezoelectric injector for storage in the energy storage device.

2. The drive circuit as defined in claim 1 further comprising a controller for controlling the switching circuitry.

3. The drive circuit as defined in claim 1, wherein the energy storage device comprises a capacitor.

4. The drive circuit as defined in claim 1, wherein the switching circuitry comprises first and second switches that are controlled to charge the injector, and third and fourth switches which are controlled to discharge the injector.

5. The drive circuit as defined in claim 1, wherein the drive circuit is substantially configured as an H-bridge circuit.

6. The drive circuit as defined in claim 1 further comprising circuitry for controlling voltage charge and discharge slew rate of the injector.

7. The drive circuit as defined in claim 6, wherein the circuitry for controlling voltage charge and discharge slew rate comprises current sensing circuitry and first and second current thresholds, wherein current flow through the bidirectional current path is controlled as a function of the first and second current thresholds.

8. The drive circuit as defined in claim 6, wherein the circuitry for controlling voltage charge and discharge slew rate comprises logic circuitry responsive to a frequency control signal.

9. The drive circuit as defined in claim 1, wherein the drive circuit is substantially configured as a half H-bridge circuit.

10. The drive circuit as defined in claim 1, wherein the switching circuitry comprises a first switch that is controlled to charge the injector, and a second switch that is controlled to discharge the injector.

11. The drive circuit as defined in claim 1, wherein the drive circuit controls first and second piezoelectric injectors, said drive circuit further comprising selector circuitry for selecting one of said first and second piezoelectric injectors.

12. The drive circuit as defined in claim 11, wherein the drive circuit charges both of said first and second piezoelectric injectors during a charge mode and discharges a selected one of the first and second piezoelectric injectors during a discharge mode.

13. The drive circuit as defined in claim 1, wherein the energy storage device comprises first and second capacitors, wherein the first capacitor stores energy for use in a charge mode and the second capacitor stores energy for use in a discharge mode.

14. A drive circuit for a piezoelectric injector, said drive circuit comprising:

a voltage input for receiving a voltage signal;

a bidirectional current path coupled to a piezoelectric injector;

an inductor coupled in series with the piezoelectric injector in the bidirectional current path; and switching circuitry for controlling current flow through the piezoelectric injector and the inductor to open and close the piezoelectric injector, wherein the switching circuitry causes a first current to flow through the bidirectional current path while charging the injector, and further causes a second current opposite to the first current to flow in the bidirectional current path to discharge the injector.

15. The drive circuit as defined in claim 14 further comprising an energy storage device coupled to the voltage input for storing an electrical charge, wherein the switching circuitry is controlled to provide a recirculation current to recover energy stored in the piezoelectric injector for storage in the energy storage device.

16. The drive circuit as defined in claim 15, wherein the energy storage device comprises a capacitor.

17. The drive circuit as defined in claim 15 further comprising circuitry for controlling voltage charge and discharge slew rate of the injector.

18. The drive circuit as defined in claim 17, wherein the circuitry for controlling voltage charge and discharge slew rate comprises current sensing circuitry and first and second current thresholds, wherein current flow through the bidirectional current path is controlled as a function of the first and second current thresholds.

19. The drive circuit as defined in claim 17, wherein the circuitry for controlling charge and discharge slew rate comprises logic circuitry responsive to a frequency control signal.

20. The drive circuit as defined in claim 14, wherein the switching circuitry comprises first and second switches that are controlled to charge the injector, and third and fourth switches that are controlled to discharge the injector.

21. The drive circuit as defined in claim 14, wherein the drive circuit is substantially configured as a half H-bridge circuit.

22. The drive circuit as defined in claim 14, wherein the switching circuitry comprises a first switch that is controlled to charge the injector, and a second switch that is controlled to discharge the injector.

23. The drive circuit as defined in claim 14, wherein the drive circuit controls first and second piezoelectric injectors, said drive circuit further comprising selector circuitry for selecting one of said first and second piezoelectric injectors.

24. The drive circuit as defined in claim 23, wherein the drive circuit charges both of said first and second piezoelectric injectors during a charge mode and discharges a selected one of the first and second piezoelectric injectors during a discharge mode.

25. The drive circuit as defined in claim 14, wherein the energy storage device comprises first and second capacitors, wherein the first capacitor stores energy for use in a charge mode and the second capacitor stores energy for use in a discharge mode.

26. A drive circuit for a piezoelectric fuel injector, said drive circuit comprising:

a voltage input for receiving a voltage signal;

an energy storage device coupled to the voltage input for storing an electrical charge;

a bidirectional current path coupled to a piezoelectric fuel injector;

an inductor coupled in series with the piezoelectric injector in the bidirectional current path; and switching circuitry for controlling current flow through the piezoelectric fuel injector and the inductor to open and close the piezoelectric fuel injector to inject fuel into an engine, wherein the switching circuitry is controlled to provide a recirculation current to recover energy stored in the piezoelectric injector for storage in the energy storage device.

27. The drive circuit as defined in claim 26, wherein the energy storage device comprises a capacitor.

28. The drive circuit as defined in claim 26, wherein the switching circuitry comprises first and second switches that are controlled to charge the injector, and third and fourth switches that are controlled to discharge the injector.

29. The drive circuit as defined in claim 26 further comprising circuitry for controlling voltage charge and discharge slew rate of the injector.

30. The drive circuit as defined in claim 29, wherein the circuitry for controlling voltage charge and discharge slew rate comprises current sensing circuitry and first and second current thresholds, wherein current flow through the bidirectional current path is controlled as a function of the first and second current thresholds.

31. The drive circuit as defined in claim 29, wherein the circuitry for controlling voltage charge and discharge slew rate comprises logic circuitry responsive to a frequency control signal.

32. The drive circuit as defined in claim 26, wherein the drive circuit is substantially configured as a half H-bridge circuit.

33. The drive circuit as defined in claim 26, wherein the switching circuitry comprises a first switch that is controlled to charge the injector, and a second switch that is controlled to discharge the injector.

34. The drive circuit as defined in claim 26, wherein the drive circuit controls first and second piezoelectric injectors, said drive circuit further comprising selector circuitry for selecting one of said first and second piezoelectric injectors.

35. The drive circuit as defined in claim 34, wherein the drive circuit charges both of said first and second piezoelectric injectors during a charge mode and discharges a selected one of the first and second piezoelectric injectors during a discharge mode.

36. The drive circuit as defined in claim 26, wherein the energy storage device comprises first and second capacitors, wherein the first capacitor stores energy for use in a charge mode and the second capacitor stores energy for use in a discharge mode.

37. A drive circuit for a piezoelectric injector, said drive circuit comprising:

a voltage input for receiving a voltage signal;

a first energy storage device coupled to the voltage input for storing an electrical charge;

a second energy storage device coupled to the voltage input for storing an electrical charge;

a bidirectional current path coupled to a piezoelectric injector;

an inductor coupled in series with the piezoelectric injector in the bidirectional current path; and switching circuitry for controlling current flow through the piezoelectric injector and the inductor to open and close the piezoelectric injector, wherein the switching circuitry comprises a first switch that is controlled to charge the piezoelectric injector and a second switch that is controlled to discharge the piezoelectric injector, wherein the switching circuitry is controlled to provide a recirculation current to recover energy stored in the piezoelectric injector in at least one of the first and second energy storage devices.

38. The drive circuit as defined in claim 37, wherein the piezoelectric injector comprises first and second piezoelectric injectors, and said drive circuit further comprises selector circuitry for selecting one of the first and second piezoelectric injectors.

39. The drive circuit as defined in claim 38, wherein the first and second piezoelectric injectors are coupled in parallel.

40. The drive circuit as defined in claim 38, wherein the drive circuit charges both of the first and second piezoelectric injectors during a charge mode and discharges a selected one of the first and second piezoelectric injectors during a discharge mode.

41. The drive circuit as defined in claim 37, wherein the switching circuitry causes a first current to flow in the bidirectional current path to charge the injector, and further causes a second current opposite to the first current to flow in the bidirectional current path to discharge the injector.

* * * * *